US007261090B2

(12) United States Patent
Ogawa

(10) Patent No.: US 7,261,090 B2
(45) Date of Patent: Aug. 28, 2007

(54) ELECTROMAGNETIC CONTROLLED FUEL INJECTOR

(75) Inventor: Hisao Ogawa, Sagamihara (JP)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 0 days.

(21) Appl. No.: 11/318,490

(22) Filed: Dec. 28, 2005

(65) Prior Publication Data

US 2006/0192027 A1 Aug. 31, 2006

(30) Foreign Application Priority Data

Feb. 28, 2005 (JP) ..... 2005-054676

(51) Int. Cl.
*F02M 37/04* (2006.01)
*F02M 37/08* (2006.01)

(52) U.S. Cl. ..... 123/506; 123/514

(58) Field of Classification Search ..... 123/505, 123/514, 446, 467, 468, 299, 300
See application file for complete search history.

(56) References Cited

U.S. PATENT DOCUMENTS 4,297,982 A * 11/1981 Lakra ..... 123/502
5,277,163 A * 1/1994 Ohishi ..... 123/467
5,333,588 A * 8/1994 Cananagh ..... 123/506
5,357,933 A * 10/1994 Kasahara et al. ..... 123/506
5,370,095 A * 12/1994 Yamaguchi et al. ..... 123/446
5,375,575 A * 12/1994 Ohishi et al. ..... 123/446
5,443,047 A * 8/1995 Ishiwata et al. ..... 123/446
5,494,220 A 2/1996 Shinogle et al.
6,305,359 B1 * 10/2001 Kronberger et al. ..... 123/506
2003/0111560 A1 6/2003 Bartkowiak et al.
2004/0099246 A1 * 5/2004 Gould ..... 123/446
2005/0133001 A1 6/2005 Kaneko
2005/0143898 A1 6/2005 Kaneko et al.
2005/0189511 A1 9/2005 Ogawa et al.
2005/0189512 A1 9/2005 Kaneko
2005/0217638 A1 10/2005 Kaneko
2006/0185650 A1 * 8/2006 Kaneko ..... 123/506

FOREIGN PATENT DOCUMENTS

DE 198 43 546 A1 3/2000
EP 0 619 423 A2 10/1994
JP 7-269438 A 10/1995
WO WO-02/04805 A1 1/2002

* cited by examiner

*Primary Examiner*—Mahmoud Gimie
(74) *Attorney, Agent, or Firm*—Birch, Stewart, Kolasch & Birch, LLP

(57) ABSTRACT

The injector is provided with an electromagnetic opening/closing valve device composed such that a command piston device is provided at an end side of the poppet valve opposite to the solenoid device. The command piston device has a command piston capable of being contacted with the end face of the end side of the poppet valve opposite to the solenoid device so that the poppet valve moves in conjunction with the move of the command piston to increase valve seat passage area for spilling the high pressure fuel in the plunger room when the solenoid device is deexcited to allow said poppet valve to be opened for spilling the high pressure fuel.

6 Claims, 5 Drawing Sheets

6
6a
5
5a
1b
3
d0
2a
4
2b
10
11
9
8
7
12
13
101
1
10a
Fuel
15
2
1a
100
S1
S2
S3

FIG.4 (B) PRIOR ART

FIG.4 (A) PRIOR ART

ELECTROMAGNETIC CONTROLLED FUEL INJECTOR

BACKGROUND OF THE INVENTION

1. Field of the Invention

The present invention relates to an electromagnetic controlled fuel injector applied to an electromagnetic controlled unit injector, etc. for diesel engine and composed such that fuel injection timing thereof is controlled by means of a poppet valve which is reciprocated by a solenoid device to open or close the passage between the fuel passage to the plunger room where fuel is received and compressed to high pressure and the spill passage to the fuel return line.

2. Description of the Related Art

An electromagnetic controlled unit injector applied to a diesel engine is composed such that fuel injection timing is controlled through shutting-off/allowing communication of a fuel passage, which connects to a plunger room where fuel is introduced and compressed to high pressure, with a spill passage connecting to a fuel return line by closing/opening a poppet valve reciprocated by means of a solenoid device. In order to improve operation stability at low load and to improve performance of output and fuel consumption, it is imperative that closing response of the poppet valve is good and injection cutoff is sharp.

There are such means as increase force for driving the poppet valve, that is, increase attraction force of the solenoid device and spring force of the poppet valve spring to increase opening/closing velocity of the poppet valve or decrease the size of the poppet valve to increase opening/closing velocity of the poppet valve in order to quicken opening/closing response of the poppet valve of the electromagnetic controlled unit injector. Opening/closing response of a poppet valve can be improved by these means.

However, in the case of increasing attraction force of the solenoid device, there is a problem that the size of the solenoid device increases.

FIGS. 4(A) and 4(B) are sectional views of the substantial part of the solenoid device and poppet valve device of an electromagnetic controlled unit injector for explaining downsizing of the poppet valve. In FIGS. 4(A) and 4(B), reference numeral 6 is a solenoid device, 6*a* is an electromagnetic coil of the solenoid device 6, 01 is a poppet valve reciprocated by the actuation of the solenoid device, 2 is a valve seal member having a seat part for allowing a seat part 4 of the poppet valve 01 to seat thereon, 5 is an armature which is fixed to the upper end of the poppet valve 01, a gap being provided between the armature 5 and the electromagnetic coil 6*a*.

In the electromagnetic controlled unit injector provided with the electromagnetic open/close valve device as shown in FIG.4(B), when the solenoid device is not excited, said gap between the armature 5 and the electromagnetic coil 6*a* is C2, and there is a valve seat passage 15 between the seat part of the poppet valve 01 and valve seat member 2.

Therefore, a plunger room not shown in the drawing is communicated to a spill passage 3 through a fuel passage 2*b*, a fuel pool 2*a* in the valve seat member 2, and the valve seat passage 15.

When the solenoid device 6 is excited, the armature 5 is attracted by the electromagnetic coil 6*a* of the solenoid device 6 to move the poppet valve 01 upward to allow the seat part 4 of the poppet valve 01 to contact with the seat part of the valve seat member, and the valve seat passage 15 is closed. Therefore, the fuel in the plunger room can be compressed to high pressure.

If the diameter d0 of the poppet valve 01 is decreased, the closing speed thereof is increased when the attraction force is the same, resulting in a quicker valve closing response, which improves operation stability at low engine load.

In JP7-269438A discloses a passage open/close valve device, in which the valve opening stroke is allowed to be long with the valve closing stroke being restricted to be short, and rapid pressure drop at the injection end is effected by the increased valve opening stroke resulting in sharpened injection cutoff.

WO 02/04805 discloses a fuel injection device, in which a main and a sub electromagnetic valve are provided, and injection rate is controlled by the effect of an orifice provided to the line provided with the sub electromagnetic valve.

In the conventional electromagnetic unit injector equipped with the electromagnetic opening/closing valve device of FIG. 4, when the diameter d0 of the poppet valve 01 shown in FIG. 4(A) is decreased to d2 as shown in FIG. 4(B) in order to quicken valve closing response at the beginning, it is necessary to increase the stroke of the poppet valve 01 from L1 in FIG. 4(A) to L2 in FIG. 4(B), for the area of the valve seat passage 15 when the poppet valve 01 is opened must be large enough in order not to deteriorate injection cutoff at the injection end.

However, when the stroke of the poppet valve 01 is increased, the gap between the electromagnetic coil 6*a* of the solenoid device 6 and the armature fixed to the poppet valve 01 must be increased by ΔC from C1 in FIG.4(A) to C2 in FIG.4(B), so closing response of the poppet valve 01 becomes slower and operation stability at low load operation of the engine is deteriorated.

According to said JP7-269438A, the opening stroke of the poppet valve can be increased to effect rapid pressure drop at the injection end in order to sharpen injection cutoff with the closing stroke by keeping short. However, in the device of the conventional art, high liquid pressure when the valve is seating exerts on members for switching valve lift, and the construction including the valve spool, stopper sleeve, springs, etc. is complicated, the number of constituent parts increases, and man-hour for manufacturing and assembling increase resulting in increased cost.

The fuel injection device disclosed in WO 02/04805 controls the transition mode of fuel injection pressure through controlling the flow of fuel return by providing variable opening orifice, not controls the stroke of the poppet valve.

SUMMARY OF THE INVENTION

The present invention is made on light of the problem of prior art and its object is to provide an electromagnetic controlled fuel injector capable of quickening closing response of the poppet valve at the injection beginning in order to improve operation stability at low load operation of an engine and capable of increasing the opening lift of the poppet valve to secure enough poppet valve seat passage area in order to sharpen injection cutoff at the injection end arid improve output and fuel consumption performance of the engine.

To achieve the object, the present invention provide an electromagnetic controlled fuel injector composed such that fuel injection timing is controlled through shutting-off/allowing communication of a fuel passage, which connects to a plunger room where fuel is introduced and compressed to high pressure, with a spill passage connecting to a fuel return line by opening/closing a poppet valve reciprocated by means of a solenoid device, wherein a command piston device is provided at an end side of said poppet valve opposite to said solenoid device, said command piston device has a command piston capable of being contacted with the end face of said end side of said poppet valve, and said command piston moves in conjunction with the move of said poppet valve so that the opening area of a valve seat passage formed between the seat parts of said poppet valve and valve seat member increases when said solenoid device is deexcited to allow said poppet valve to be opened for spilling high pressure fuel.

In the invention, it is preferable to compose concretively as follows.

(1) Said command piston device is composed such that the movement of said command piston toward said poppet valve is restricted by allowing the command piston to contact with an end face of a valve seat member for said poppet valve when said poppet valve is closed (when said valve seat passage is closed), and when said solenoid device is deexcited to allow said poppet valve to be opened for spilling high pressure fuel, said command piston is moved from said restricting position, i.e. said end face of the valve seat member, by the exertion of the pressure of the high pressure fuel in said plunger room so that said poppet valve is moved by a certain distance in the direction the opening area of said valve seat passage is increased with said poppet valve contacting with said command piston.

(2) Said command piston device is composed such that liquid pressure is allowed to be exerted on the back of said command piston to push the command piston toward said restricting position.

According to the invention, by providing the command piston device having the command piston capable of being contacted with the end face of the valve seat member opposite to the solenoid device side, the poppet valve is allowed to move in the direction the area of the valve seat passage increases by a certain distance together with the command piston moved in the direction departing from the restricted position thereof by the exertion of the pressure of the high pressure fuel in the plunger room when the solenoid valve device is deexcited and the high-pressure fuel is spilled. Therefore, with decreased diameter of the poppet valve, the valve seat passage can be increased by the movement of the poppet valve in conjunction with the movement of the command piston in the direction to increase the valve seat passage area during the spilling of the high pressure fuel at the injection end.

Therefore, according to the invention, closing response of the poppet valve can be quickened, i.e. the poppet valve can be closed rapidly without deteriorating injection cutoff at the injection end. Accordingly, operation stability at low load operation of the engine is improved and output and fuel consumption performance can be improved.

Further, the command piston device is of simple construction as is provided with a command piston capable of being contacted to the end face of the valve seat member opposite to the solenoid device side, and composed such that the pressure of the high pressure fuel does not exert on the constituent parts of the command piston device when the poppet valve is seated to the valve seat member, so the effect that closing response of the poppet valve at the injection beginning can be achieved together with the effect that injection cutoff at the injection end can be sharpened with a device of simple construction with small number of constituent parts resulting in easiness in manufacturing and assembling.

The command piston device can control the amount of movement and moving speed thereof through changing the liquid pressure exerting on the back of the command piston by an ECU (controller) of the engine in accordance with engine operation conditions. Therefore, the opening area of the valve seat passage and opening speed thereof can be controlled, and an injection rate control system capable of properly controlling injection rate can be realized.

It is preferable in the invention that an auxiliary spill passage which is opened/closed by the slide of said poppet valve is provided, and said auxiliary spill passage is opened to allow a fuel passage connecting to said plunger room to communicate with said spill passage when said poppet valve is opened for spilling high pressure fuel in the plunger room so that the high pressure fuel can be spilled through both a valve seat passage formed between the seat parts of said poppet valve and a valve seat member into which said poppet valve is inserted and said auxiliary spill passage is closed with said poppet valve when said poppet valve is closed.

More specifically, it is preferable to composes such that said auxiliary spill passage is composed of first spill holes provided to said poppet valve and second spill holes provided to a sleeve fixed to said poppet valve; and when said poppet valve is opened for allowing spilling of high pressure fuel, each of said first spill holes and each of said second spill holes are allowed to be communicated with each other so that the high pressure fuel is spilled through both the valve seat passage of said poppet valve and said auxiliary spill passage; and when said poppet valve is closed, the communication of said first spill holes with said second spill holes is shutoff by said poppet valve.

According to the invention, an auxiliary spill passage is provided which is opened when the poppet valve is opened and closed when the poppet valve is closed, concretively the auxiliary passage being composed such that first spill holes are formed in the poppet valve and second spill holes are formed in the sleeve fixed to the valve seat member so that the first and second holes are communicated when the poppet valve is opened and the second holes are shut by the poppet valve when the poppet valve is closed, so that when the poppet valve is opened to spill the high pressure fuel in the plunger room, the fuel is spilled through both the valve seat passage and the auxiliary spill passage. Therefore, even when the diameter of the poppet valve is decreased, enough area for spilling the fuel can be secured by the sum of the valve seat passage and the auxiliary passage without increasing the gap between the solenoid device and the armature fixed to the poppet valve.

Therefore, according to the invention, it becomes possible to quicken closing response of the poppet valve at the injection beginning and sharpen injection cutoff at the injection end, so operation stability at low load of operation of the engine output and fuel consumption performance can be improved.

Further, according to the invention, the construction is simple as is composed by forming first spill holes in the poppet valve and second spill holes in the sleeve fixed to the valve seat member, so that the effect that closing response of the poppet valve at the injection beginning is quickened can be obtained together with the effect that injection cutoff at the injection end can be sharpened with a device of simple construction with small number of constituent parts resulting in easiness in manufacturing and assembling.

According to the invention, even with the diameter of the poppet valve decreased in order to improve poppet valve closing response at the injection beginning, the opening area of the valve seat passage formed by the opening of the poppet valve at the injection end for spilling high pressure fuel can be increased without increasing the gap between the electromagnetic coil of the solenoid device and the poppet valve.

Further, according to the invention, by composing such that the first auxiliary holes is allowed to communicate with the second auxiliary holes and the high pressure fuel is spilled through both the valve seat passage and the auxiliary spill passage formed by the communication of the first and second auxiliary holes, the high pressure fuel can be spilled from both the valve seat passage and the auxiliary spill passage formed by the communication of the first and second auxiliary holes without increasing the gap between the electromagnetic coil of the solenoid device and the poppet valve.

As has been described in the foregoing, according to the invention, it becomes possible to quicken closing response of the poppet valve at the injection beginning and sharpen fuel injection cutoff at the injection end, and operation stability at low load operation of the engine and output and fuel consumption performance can be improved.

Further, as the electromagnetic open/close device described above can be composed by simply providing the command piston device having the command piston capable of contacting the end face of the poppet valve opposite to the solenoid device or by simply providing the first auxiliary holes in the poppet valve and the second auxiliary holes in the sleeve fixed to the valve seat member in which the poppet valve is fitted, the effect that closing response of the poppet valve at the injection beginning is quickened can be obtained together with the effect that injection cutoff at the injection end can be sharpened with a device of simple construction with small number of constituent parts resulting in easiness in manufacturing and assembling.

DETAILED DESCRIPTION OF THE INVENTION

An embodiment of the present invention will now be detailed with reference to the accompanying drawings. It is intended, however, that unless particularly specified, dimensions, materials, relative positions and so forth of the constituent parts in the embodiments shall be interpreted as illustrative only not as limitative of the scope of the present invention.

Figure 3:
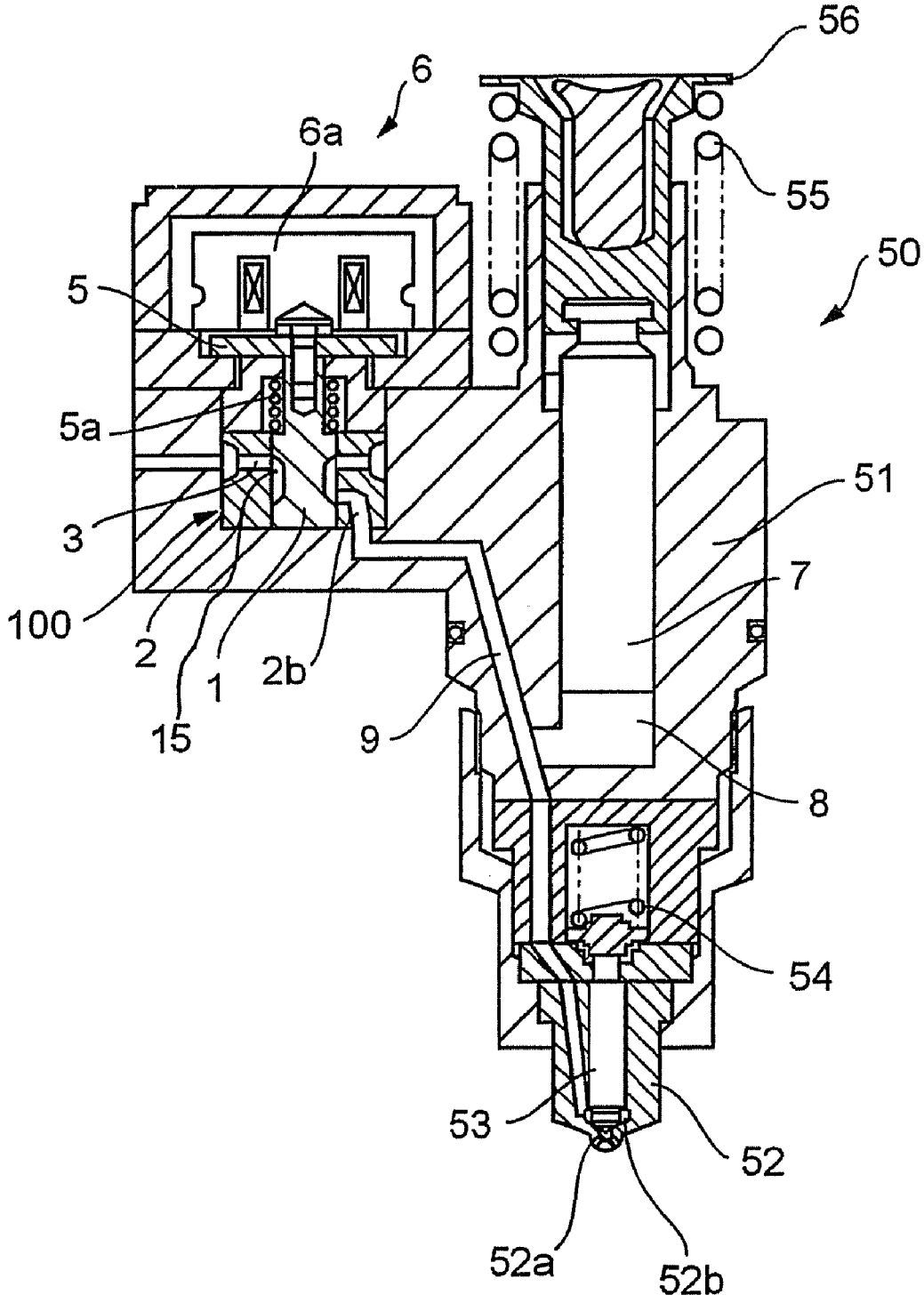
FIG. 3 is a longitudinal sectional view of an electromagnetic controlled unit injector for a diesel engine to which the present invention is applied.
Figure 4:
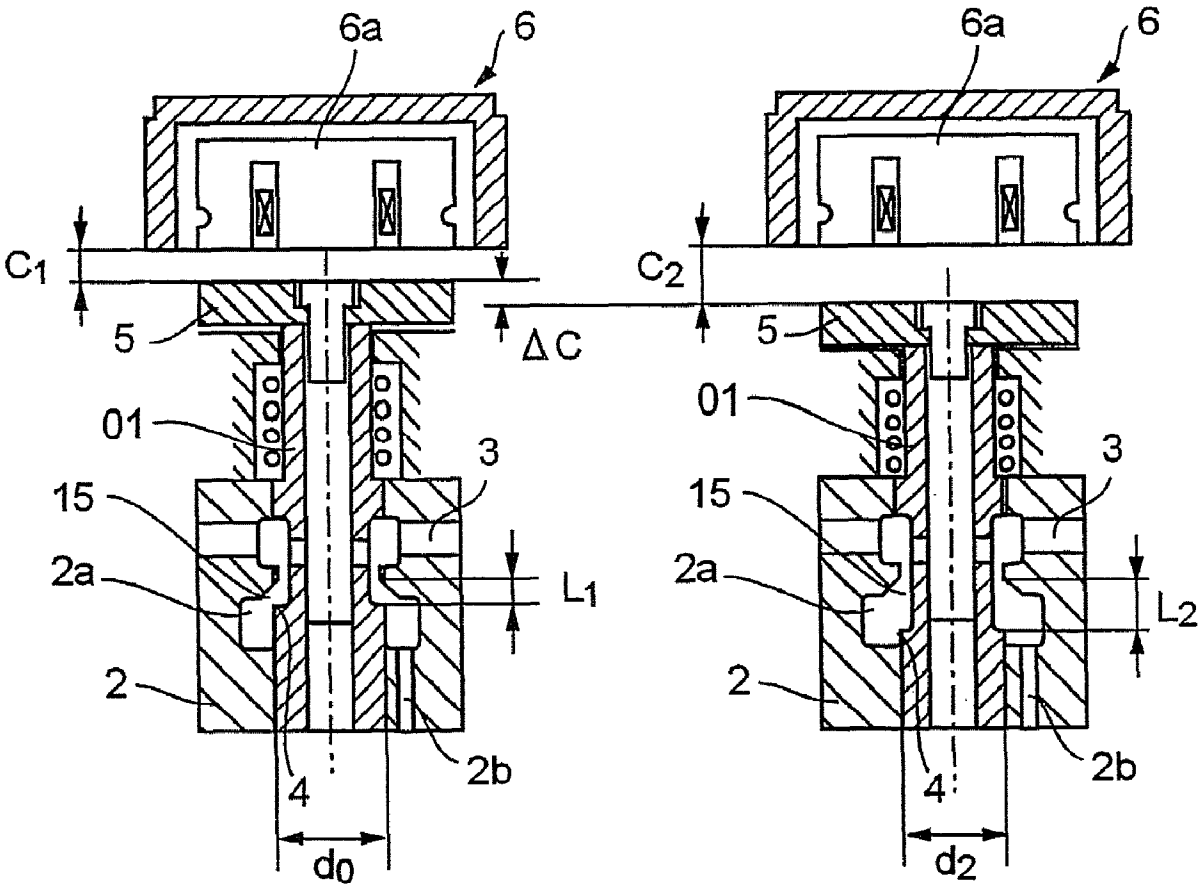
FIGS. 4(A), (B) are sectional views of the same part as that of FIG. 1 according to a conventional art.

FIG. 3 is a longitudinal sectional view of an electromagnetic controlled unit injector for a diesel engine to which the present invention is applied.

In FIG. 3, reference numeral 50 is an electromagnetic controlled unit injector, which is composed as follows. Reference numeral 51 is an injector body, 7 is a plunger provided for reciprocation in the injector body, 56 and 55 are respectively a tappet and a tappet spring for reciprocating the plunger 7, 8 is a plunger room where fuel is introduced and compressed to high pressure by the reciprocation of the plunger, 9 is a fuel line, 52 is a fuel injection nozzle having injection holes 52*a* through which the fuel compressed to high pressure in the plunger room 8 is injected to the combustion chamber of an engine not shown in the drawing, 53 is a needle valve provided for reciprocation in the fuel injection nozzle 52, and 54 is a spring for allowing the needle valve 53 to open or close the injection holes.

Reference numeral 100 is an electromagnetic open/close valve device, which is composed as follows.

Reference numeral 1 is a poppet valve, 2 is a valve seat member in which the poppet valve 1 is fitted for reciprocation, 5*a* is a poppet valve spring, 2*b* is a fuel passage communicating with the fuel passage 9 in the injector body 51, and 3 is a spill passage.

Reference numeral 6 is a solenoid device provided with an electromagnetic coil 6*a*, 5 is an armature which is fixed on the top end of the poppet valve 1 and can be pulled up together with the poppet valve 1 by the electromagnetic force generated by the coil 6*a* or pushed down by the spring force of the poppet valve spring 5*a*.

In the operation of the diesel engine equipped with the electromagnetic controlled unit injector 50, fuel is introduced in the plunger room 8 and compressed to high pressure therein by the reciprocation of the plunger 7 reciprocated by means of the tappet 56 and tappet spring 55 driven by the rotation of a fuel cam (not shown in the drawing) of the engine.

When the electromagnetic coil 6*a* of the solenoid device 6 is not excited, the poppet valve 1 is pushed down by the poppet valve spring 5*a* to open a valve seat passage 15 between the poppet valve 1 and the valve seat member 2. In this state, the plunger 7 is moved upward and fuel supplied by a fuel feed pump(not shown in the drawing) is introduced to the plunger room 8 through the spill passage 3, said opened valve seat part, and the fuel passage 2*b* and 9.

When the armature 5 fixed to the poppet valve 1 is pulled up against the spring force of the poppet valve spring 5*a* by exciting the magnetic coil 6*a* of the solenoid device 6 and said valve seat passage 15 is closed during the plunger 7 is moved down, the pressure of fuel in the plunger room 8, fuel passage 2*b* in the electromagnetic open/close valve device 100, and fuel passage 9 and fuel pool 2*b* in the injector body 9 is increased as the plunger 7 moves down.

When fuel pressure exceeds the opening pressure of the needle valve 53, the needle valve 53 is lifted against the spring force of the needle valve spring 54 to open the injection holes 52*a* and the fuel in the fuel pool 52*b* is injected through the injection holes 52*a* to the combustion chamber not shown in the drawing.

Then, when the excitation of the solenoid device 6 is released, the armature 5 to which the poppet valve 1 is fixed is pulled down by the spring force of the poppet valve spring 5*a* and the poppet valve is opened to form a seat gap at the seat part of the poppet valve 1 and valve seat member 2, so the fuel in the plunger room 8 is discharged to the spill passage 3 through the fuel passage 9, fuel passage 2*b*, and said seat gap.

The present invention relates to an improvement of the electromagnetic valve device 100 of an electromagnetic controlled unit injector 50 and the like.

Figure 1:
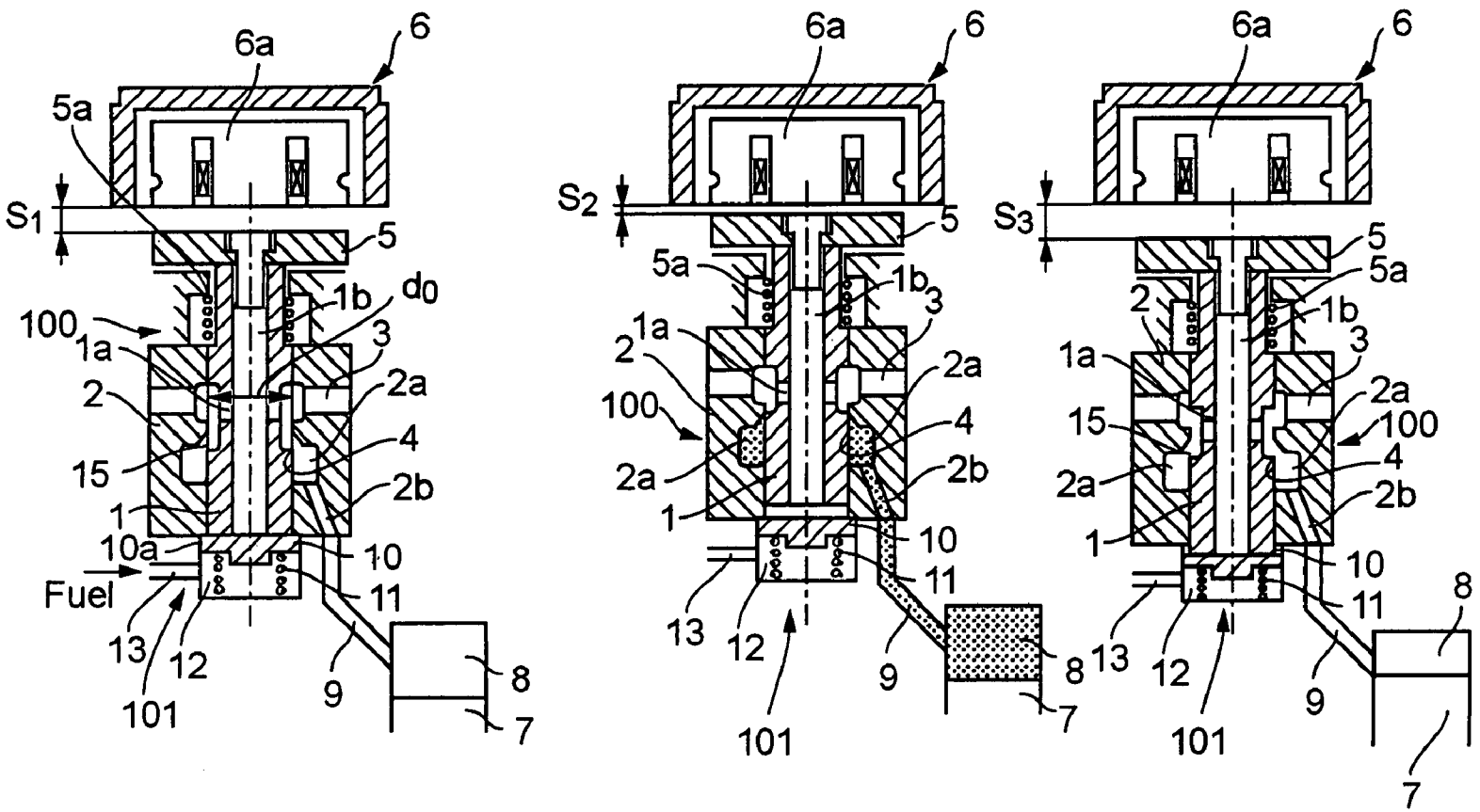
FIG. 1 is a sectional view of the substantial part of the first embodiment of the solenoid device and poppet valve device of the electromagnetic controlled unit injector for a diesel engine according to the present invention, (A) shows when the poppet valve is opened in an ordinary condition, (B) shows when the poppet valve is closed, and (C) shows when the poppet valve is opened maximally (when spilling).

FIG. 1 is a sectional view of the substantial part of the first embodiment of the solenoid device and poppet valve of the electromagnetic controlled unit injector for a diesel engine according to the present invention, FIG. 1(A) shows when the poppet valve is opened in an ordinary condition, FIG. 1 (B) shows when the poppet valve is closed, and FIG. 1 (C) shows when the poppet valve is opened maximally (when spilling).

Referring to FIG. 1, reference numeral 6 is a solenoid device, 6*a* is a electromagnetic coil of the solenoid device, 5*a* is a poppet valve spring, 1 is a poppet valve which can be reciprocated by the actuation of the solenoid device and the poppet valve spring 5*a*, 2 is a valve seat member in which the poppet valve 1 is fitted for reciprocation, a seat part 4 being formed between the poppet valve and the valve seat member 2.

Reference numeral 2*a* is a fuel pool communicating to the fuel passage 2*b*, 1*a* is a spill passage of the poppet valve, 3 is a spill passage of the valve seat member 2, the spill passage 3 communicating to the spill passage 1*a* of the poppet valve 1.

Reference numeral 5 is an armature which is fixed on the top end of the poppet valve 1 and can be pulled up together with the poppet valve 1 by the electromagnetic force generated by the coil 6*a* or pushed down by the spring force of the poppet valve spring 5*a*.

Reference numeral 101 is a command piston device, which is located at an end part of the poppet valve 1 opposite to the solenoid device and composed as follows.

Reference numeral 10 is a command piston fitted for reciprocation into a command cylinder 10*a*, 12 is an oil chamber under the valve seat member 2, the command piston being inserted in the oil chamber 12 and pressurized oil being supplied to the oil chamber 12 from an oil pipe 13. Reference numeral 11 is a spring to push the command piston 10 toward the lower end of the valve seat member 2.

In the first embodiment, as shown in FIG. 1(A), when the solenoid device 6 is not excited and there is a gap S1 between the armature 5 and the electromagnetic coil 6*a*, and when the pressure rise in the plunger room 8 due to compression by the plunger 7 is small, concretively when the force exerting downward on the command piston 10 due to the fuel pressure in the plunger room 8 is lower than the sum of the force exerting upward on the command piston 10 due to the pressure in the oil chamber 12 and the spring force of the spring 11, the command piston 10 is moved upward until the same contacts the lower end face of the valve seat member 2 with the lower end face of the poppet valve 1 contacting the upper face of the command piston 10, and the opening area of the seat passage 15 becomes the area corresponding to the gap S1.

Then, when the solenoid device 6 is excited and the armature 5 is attracted by the electromagnetic coil 6*a* until the gap S1 becomes a smaller gap S2 and the seat 4 of the poppet valve 1 contacts the seat of the valve seat member 2 to close the seat passage 15 as shown in FIG. 1(B), the pressure of the fuel in the plunger room 8, fuel passage 2*b* in the electromagnetic open/close valve device 100, fuel passage in the injector body 9, and fuel pool 52*b*(see FIG. 3) rises as the plunger 7 further compresses the fuel in the plunger room. When the fuel pressure exceeds the opening pressure of the needle valve 53 which is pushed downward by the needle valve spring, the needle valve 53 is lifted to open the injection holes 52*a* and the high-pressure fuel is injected into the combustion chamber not shown in the drawing.

At this time, as said high pressure of fuel does not exert on the command piston 10, the same continues to be contacted to the lower end face of the valve seat member 2.

Then, when the excitation of the solenoid device 6 is released, the poppet valve 1 fixed to the armature is moved downward by the spring force of the poppet valve spring 5*a* and the seat passage 15 opens, and the high pressure fuel in the plunger room 8, fuel passage 2*b*, and fuel pool 2*a* is discharged to the spill passage 3.

Upon the spilling of the high-pressure fuel, the fuel pressure exerts on the upper face of the command piston 10 through the valve seat passage 15 and the spill passage 1*a* of the poppet valve 1.

The fuel pressure overcomes the sum of the oil pressure in the oil chamber 12 and the spring force of the spring 11 and the command piston 10 is moved downward, and the poppet valve 1 is moved downward together with the armature 5 by the spring force of the poppet valve spring as the command piston 10 moves downward. By this, the gap S3 between the armature 5 and electromagnetic coil 6*a* becomes larger than the gap S1 shown in FIG. 1(A). So, the downward travel of the poppet valve 1 from its seated position is increased and opening area of the valve seat passage 15 is increased.

As the opening area of the valve seat passage 15 is increased by the increased downward travel of the poppet valve 1 when the high pressure fuel is spilled, an area of the valve seat passage 15 sufficient enough for effecting good cut-off of injection can be secured even with decreased diameter of the poppet valve 1.

Therefore, according to the first embodiment, as the injector is composed such that the command piston device 101 is provided at the end side of the poppet valve 1 opposite to the solenoid device 6, and the command piston 10 is moved downward from the restricting position, i.e. the bottom face of the valve seat member 2 by the exertion of pressure from the high pressure fuel in the plunger room 8 when the solenoid device 6 is deexcited and the poppet valve is moved in the direction the area of the valve seat passage 15 increases, so the increased opening area of the valve seat passage 15 can be kept during the spilling of the high pressure fuel at the end of fuel injection even with the diameter d0 of the poppet valve being decreased in order to quicken closing response of the poppet valve at the injection beginning, resulting in a sharp cutoff of fuel injection at the injection end.

Accordingly, with the first embodiment, closing response of the poppet valve at the injection beginning is quickened and fuel injection cutoff at the injection end is sharpened, as a result operation stability at low load operation of the engine can be improved and output and fuel consumption performance can be improved.

The command piston device 101 is composed simply with the command piston 10 located at an end side of the poppet valve 1 opposite to the solenoid device 6 side to be capable of contacting said end side face of the poppet valve 1, and as it is composed such that the pressure of the high pressure fuel does not exert on the constituent components of the command piston device 10, the device is simple in construction with small number of component parts and easy in manufacturing and assembling.

Figure 5:
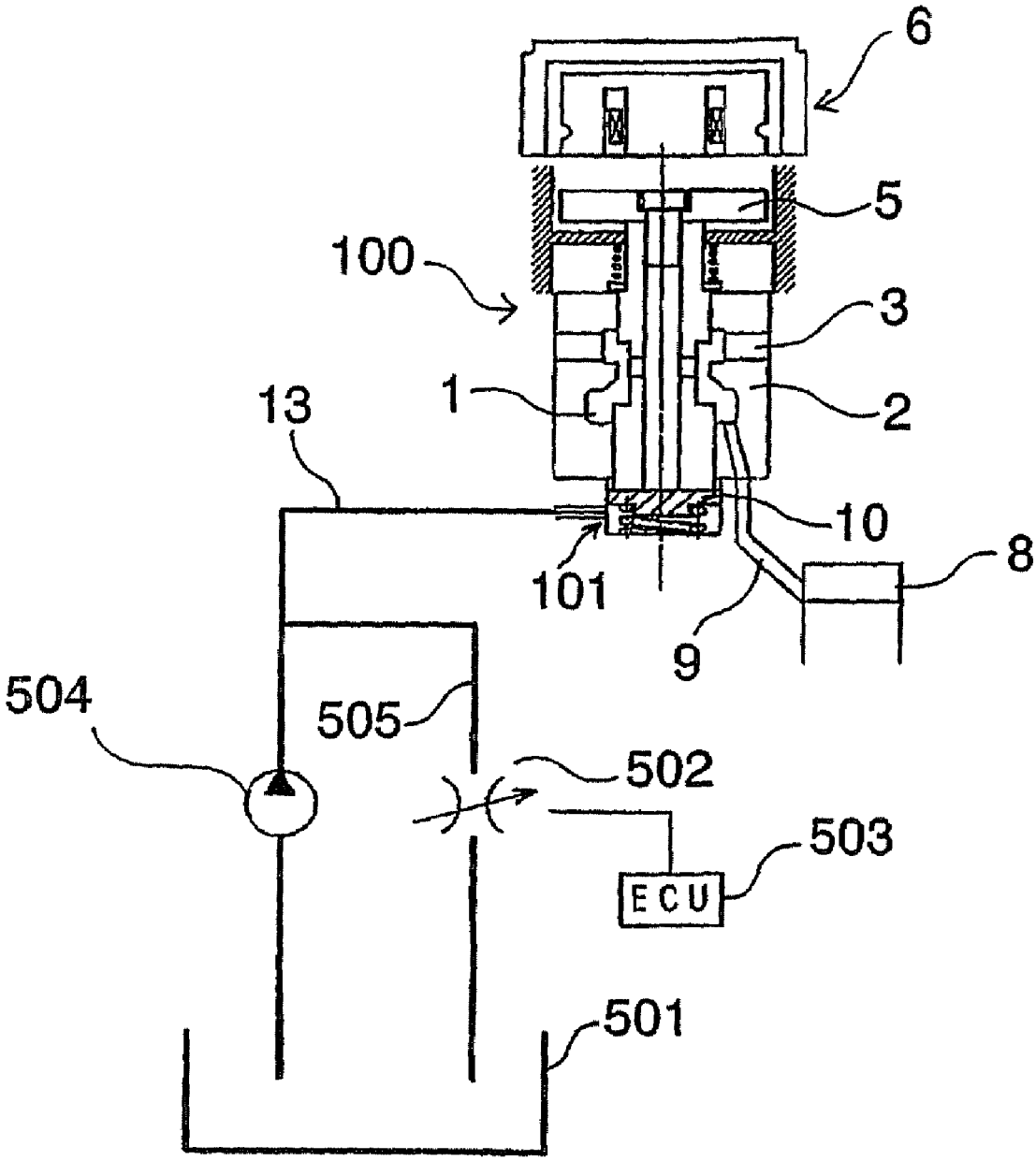
FIG. 5 is a schematic diagram of the fuel feed line of the first embodiment.

Further, as shown in FIG. 5, by varying the pressure of the liquid supplied to the back side of the command piston 10 by an oil supply pump 504 through an oil pipe 13 by varying the opening of a variable throttle valve 502 by means of an ECU (controller) 503 in accordance with engine operating conditions, the amount and speed of movement of the command piston can be controlled, i.e. the opening area of the poppet valve can be controlled, proper injection characteristic can be achieved in any operation conditions.

Figure 2:
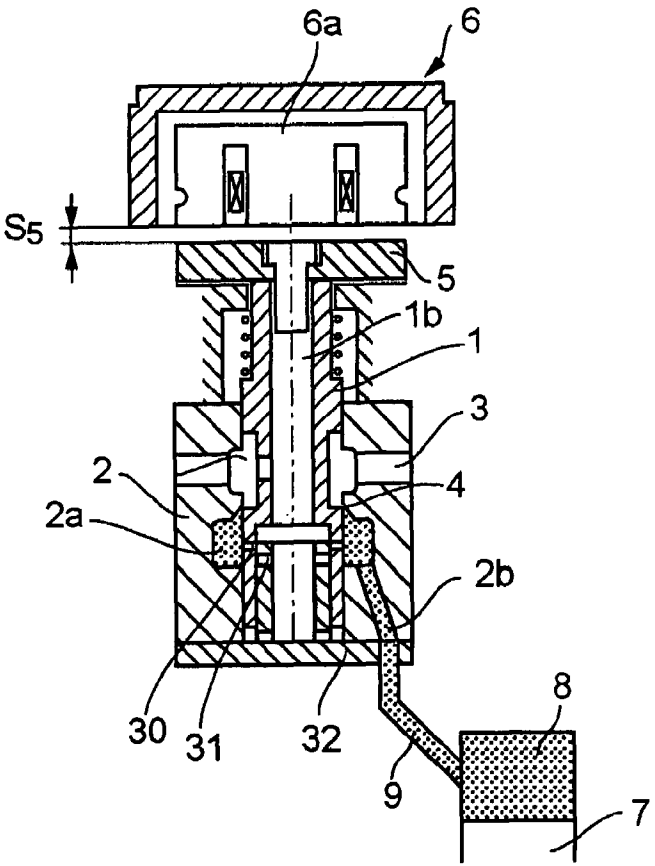
FIG. 2 is a sectional view of the same part as that of FIG. 1 of the second embodiment, (A) shows when the auxiliary spill passage is opened, and (B) shows when the auxiliary spill passage is closed.
Figure 2:
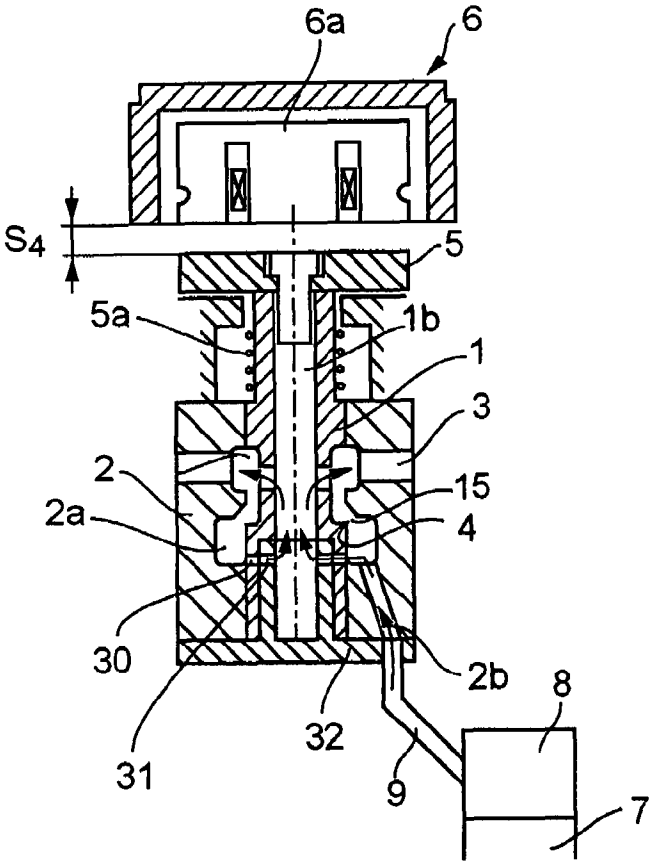

FIGS. 2(A), (B) show the second embodiment of the present invention, (A) shows when the auxiliary spill passage is opened, and (B) shows when the auxiliary spill passage is closed. In the second embodiment, there is provided an auxiliary spill passage which is opened or closed by movement of the poppet valve 1, concretively, first auxiliary spill holes 30 are drilled in the poppet valve 1 and second auxiliary spill holes 31 are drilled in a sleeve 32 fixed to the valve seat member 2. In the drawings, constituent members same as those of the first embodiment of FIG. 1 are indicated with the same reference numeral respectively.

In the second embodiment, when the solenoid device 6 is not excited, there is a gap S4 between the armature 5 and the electromagnetic coil 6*a* and the poppet valve 1 is opened as shown in FIG. 2(A). When the poppet valve 1 is opened, each of the first auxiliary spill holes 30 and each of the second auxiliary spill holes 31 are communicated with each other, and spilling of high pressure fuel occurs through the communicating spill holes 30 and 31 as shown by arrows in FIG. 2(A) in addition to the spilling through the seat passage 15. Therefore, the high pressure fuel can be spilled through the valve seat passage 15 and the first and second spill holes 30, 31, as a result area of spill passage is increased.

The poppet valve 1 is lifted up to close the valve seat passage 15 when the solenoid device 6 is excited as shown in FIG. 2(B), and at the same time the communication of the first auxiliary holes 30 with the second auxiliary holes 31 is shutoff by the lifting of the poppet valve 1. Therefore, the plunger room 8 is brought to be not communicated to the spill passage 3, and the pressure in the plunger room 8 increases as the plunger 7 moves upward in FIG. 1(B) to perform high pressure fuel injection.

According to the second embodiment, the electromagnetic open/close valve device is composed such that, an auxiliary spill passage is provided which is composed so that the fuel passage 2*b* connecting to the plunger room 8 is allowed to be communicated to the spill passage 3 when the poppet valve 1 is opened and the auxiliary passage is closed when the poppet valve 1 is closed, concretively the auxiliary spill passage is composed of first spill holes 30 drilled in the poppet valve 1 and second spill holes 31 drilled in the sleeve 32 fixed to the valve seat member 2, the first and second spill holes are allowed to be communicated when the poppet valve 1 is opened and the communication is shutoff when the poppet valve 1 is closed by the result of the slide of the poppet valve 1. Therefore, when the poppet valve 1 is opened, the high pressure fuel in the plunger room 8 can be spilled through the valve seat passage 15 and the auxiliary spill passage, i.e. through the first and second spill holes 30, 31. Therefore, the high pressure fuel in the plunger room 8 can be spilled through both the valve seat passage 15 and the auxiliary spill passage, so a large spill passage area can be secured even if the diameter d0 of the poppet valve is decreased for effecting quicker response of the poppet valve at the injection beginning.

Therefore, according to the second embodiment, it becomes possible that closing response of the poppet valve at the injection beginning is quickened and fuel injection cutoff at the injection end is sharpened, and improvement in operation stability at low load operation of the engine and output and fuel consumption performance can be achieved.

Further, according to the second embodiment, as the electromagnetic open/close valve device is simply composed by providing the first auxiliary spill holes 30 in the poppet valve and the second auxiliary spill holes 31 in the sleeve 32 fixed to the valve seat member 2, the device is simple in construction with small number of constituent parts and easy in manufacturing and assembling.

According to the present invention, an electromagnetic controlled fuel injector capable of improving closing response of the poppet valve at the injection beginning by decreasing the diameter of the poppet valve and sharpening injection cutoff at the injection end by increasing the opening area of the valve seat passage at the injection end can be obtained which is provided with an electromagnetic open/close valve device which is simple in construction with small number of constituent parts and easy in manufacturing and assembling, and as a result good operation stability at low load operation of the engine is effected and output and fuel consumption performance can be improved.

What is claimed is:

1. An electromagnetic controlled fuel injector composed such that fuel injection timing is controlled through shutting-off/allowing communication of a fuel passage, which connects to a plunger room where fuel is introduced and compressed to high pressure, and composed with a spill passage connecting to a spill line by opening/closing a poppet valve reciprocated by means of a solenoid device, wherein a command piston device is provided at an end side of said poppet valve opposite to said solenoid device, said command piston device has a command piston capable of being contacted with the end face of said end side of said poppet valve, and said command piston moves in conjunction with the move of said poppet valve so that the opening area of a valve seat passage formed between the seat parts of said poppet valve and valve seat member increases when said solenoid device is deexcited to allow said poppet valve to be opened for spilling high pressure fuel.

2. The electromagnetic controlled fuel injector according to claim 1, wherein said command piston device is composed such that the movement of said command piston toward said poppet valve is restricted by allowing the command piston to contact with an end face of a valve seat member for said poppet valve when said poppet valve is closed by the excitation of said solenoid device (when said valve seat passage is closed), and when said solenoid device is deexcited to allow said poppet valve to be opened for spilling high pressure fuel said command piston is moved from said restricting position, i.e. contacting said end face of the valve seat member, by the exertion of the pressure of the high pressure fuel in said plunger room so that said poppet valve is moved by a certain distance in the direction the opening area of said valve seat passage is increased with said poppet valve contacting with said command piston.

3. The electromagnetic controlled fuel injector according to claim 2, wherein said command piston device is composed such that liquid pressure is allowed to be exerted on the back of said command piston to push the command piston toward said restricting position.

4. The electromagnetic controlled fuel injector according to claim 3, wherein the amount of movement of said command piston can be controlled by controlling the liquid pressure exerting on the back of said command piston.

5. An electromagnetic controlled fuel injector composed such that fuel injection timing is controlled through shutting-off/allowing communication of a single fuel line, which connects to a plunger room where fuel is introduced and compressed to high pressure, and composed with a spill passage adapted to be connected to the single fuel line by opening/closing a poppet valve reciprocated by means of a solenoid device, wherein an auxiliary spill passage which is opened/closed by the slide of said poppet valve is provided, wherein said auxiliary spill passage is opened to allow the single fuel line connecting to said plunger room to communicate with said spill passage when said poppet valve is opened for spilling high pressure fuel so that the high pressure fuel in the plunger room is spilled through both a valve seat passage formed between the seat parts of said poppet valve and a valve seat member into which said poppet valve is inserted and said auxiliary spill passage and said auxiliary spill passage is closed with said poppet valve when said poppet valve is closed.

6. An electromagnetic controlled fuel injector composed such that fuel injection timing is controlled through shutting-off/allowing communication of a fuel passage, which connects to a plunger room where fuel is introduced and compressed to high pressure, and composed with a spill passage connecting to a spill line by opening/closing a poppet valve reciprocated by means of a solenoid device, wherein an auxiliary spill passage which is opened/closed by the slide of said poppet valve is provided, wherein said auxiliary spill passage is opened to allow a fuel passage connecting to said plunger room to communicate with said spill passage when said poppet valve is opened for spilling high pressure fuel so that the high pressure fuel in the plunger room is spilled through both a valve seat passage formed between the seat parts of said poppet valve and a valve seat member into which said poppet valve is inserted and said auxiliary spill passage and said auxiliary spill passage is closed with said poppet valve when said poppet valve is closed, wherein said auxiliary spill passage is composed of first spill holes provided to said poppet valve and second spill holes provided to a sleeve fixed to said poppet valve; and when said poppet valve is opened for allowing spilling of high pressure fuel, each of said first spill holes and each of said second spill holes are allowed to be communicated with each other so that the high pressure fuel is spilled through both the valve seat passage of said poppet valve and said auxiliary spill passage; and when said poppet valve is closed, the communication of said first spill holes with said second spill holes is shutoff by said poppet valve.

* * * * *